US007380987B2

(12) United States Patent
Persson

(10) Patent No.: US 7,380,987 B2
(45) Date of Patent: Jun. 3, 2008

(54) DEVICE AND METHOD FOR CLOSING AND FILLING SACKS

(76) Inventor: Thomas Persson, Tjustorps Nygård, S-233 92 Svedala (SE)

( * ) Notice: Subject to any disclaimer, the term of this patent is extended or adjusted under 35 U.S.C. 154(b) by 543 days.

(21) Appl. No.: 10/503,023

(22) PCT Filed: Jan. 24, 2003

(86) PCT No.: PCT/SE03/00120

§ 371 (c)(1),
(2), (4) Date: Jul. 29, 2004

(87) PCT Pub. No.: WO03/066458

PCT Pub. Date: Aug. 14, 2003

(65) Prior Publication Data

US 2005/0100249 A1 May 12, 2005

(30) Foreign Application Priority Data

Feb. 4, 2002 (SE) ..... 0200302

(51) Int. Cl.
*B65D 33/16* (2006.01)

(52) U.S. Cl. ..... 383/96; 383/67; 383/93; 222/92; 222/107; 222/563

(58) Field of Classification Search ..... 383/96, 383/67, 80, 202; 206/540, 528; 222/630, 222/522, 525, 509, 319
See application file for complete search history.

(56) References Cited

U.S. PATENT DOCUMENTS

| | | | | | |
|---|---|---|---|---|---|
| 48,422 | A | * | 6/1865 | Matthews | 215/264 |
| RE2,386 | E | * | 10/1866 | Albertson | 215/264 |
| 504,138 | A | * | 8/1893 | Schrader | 383/96 |
| 876,101 | A | * | 1/1908 | Schweinert et al. | 383/96 |
| 1,048,226 | A | | 12/1912 | Stone | |
| 1,075,099 | A | * | 10/1913 | Gruettner | 222/512 |
| 1,162,189 | A | * | 11/1915 | Hyatt | 123/311 |
| 1,237,930 | A | * | 8/1917 | Malvern et al. | 383/6 |
| 1,467,608 | A | | 9/1923 | Conway | |
| 1,588,847 | A | * | 6/1926 | McGee | 383/96 |
| 2,572,167 | A | * | 10/1951 | Lowe, Jr. | 222/322 |
| 3,028,897 | A | * | 4/1962 | Gooding | 383/19 |
| 3,220,610 | A | | 11/1965 | Specketer | |
| 3,851,688 | A | * | 12/1974 | de Winter | 383/96 |

FOREIGN PATENT DOCUMENTS

EP 1136045 A2 * 9/2001

* cited by examiner

*Primary Examiner*—Nathan J. Newhouse
*Assistant Examiner*—Jack Morgan
(74) *Attorney, Agent, or Firm*—Fredrikson & Byron, P.A.

(57) ABSTRACT

The invention relates to a device (10) for closing an opening or filling through an opening in a sack (25) for storing materials (26). The device (10) comprises an elongated means (11) for introduction into the sack (25) through the opening, wherein the elongated means (11) is introducible into the sack (25) for closing or filling thereof. The device (10) further comprises a plate (12) having at least one substantially flat side for abutment against an outer side around the opening of the sack (25). The elongated means (11) is projecting substantially perpendicular from the substantially flat side of the plate (12). Also included is a method for closing an opening or filling through an opening in a sack.

9 Claims, 7 Drawing Sheets

DEVICE AND METHOD FOR CLOSING AND FILLING SACKS

FIELD OF THE INVENTION

The present invention relates to a device and a method for a sack. More specifically the present invention relates to a device and a method for closing and filling disposable sacks. This type of sacks is commonly used when storing materials such as pellets, granules or the similar. For example, such sacks are used in the field of agriculture for storing grain, seed, synthetic fertilizer etc. Such sacks generally hold a considerable volume and are commonly referred to as big-bags or single use big-bags. This type of sacks is generally opened by making an opening in the bottom of the sack, wherein the contents thereof can be used for the intended purpose. The present invention relates particularly to a device and method for closing and filling such an opened single use sack.

PRIOR ART

This type of single use big-bags is generally completely closed. When the content of the sack is to be used an opening is arranged in the sack, wherein the contents can be brought out of the sack and used for the intended purpose. Generally the opening is arranged in the bottom of the sack. For example the opening is made by means of a cutting tool. This type of sacks is commonly formed in a woven material, which is somewhat elastic. Such sacks are, for example, designed to contain 1000 kg of material.

One drawback with such sacks is that they can not be closed again when opened. This is a problem particularly when only a part of the content of the sack has been used, wherein the remaining material not can be stored in the sack.

Another drawback with such sacks is that it is difficult to fill the sack with material. For example, this is a problem when spilled material is to be reintroduced into the sack.

Within the field of closing big-bags, sacks comprising a double bottom and/or a so called sleeve coupling arranged in the bottom of the sack are found in the prior art, wherein an opening in the bottom of the sack can be closed by means of a rope or the similar. This type of prior art sack thus comprises a hanging down portion around the opening, which can be closed by pulling together the sack around the opening. Generally the rope is arranged in the lowermost part of the hanging down portion. Then the remaining material in the sack can be stored at least temporarily. When the material in the sack is to be used the rope is loosened so that the material can be brought out of the sack through the opening.

One problem when closing such prior art sacks is that specially designed sacks are required to allow the closing. Thus, the closing means is an integral part of the sack. This results in extensive costs due to that each sack comprises closing means.

BRIEF DESCRIPTION OF THE INVENTION

One object of the invention is to negate above mentioned disadvantages and problems with closing or filling of single use sacks of prior art. The device according to the invention will allow closing of opened sacks and filling of such sacks with material. One additional object of the invention is to provide a reusable device for closing and filling of sacks, wherein the device can be used for the same sack or different sacks. Yet another object of the invention is to provide a method for closing or filling sacks and in particular single use big-bags.

The device according to the invention may comprise an elongated means for introduction into a sack and a plate for abutment against an outer side of the sack. The elongated means can be arranged so that it projects substantially perpendicular from the plate. The elongated means can be arranged at the plate by conventional means, such as by means of a screw, nail or the similar and/or glue or another adhesive. Alternatively the elongated means and the plate can be formed as one integrated unit. For example, the elongated means can be arranged with substantially circular circumference or substantially circular cross section for introduction into an opening in the sack having a corresponding design.

The plate can be formed with at least one substantially flat side for abutment against the elongated means and abutment against the outer side of the sack. The term substantially flat also includes a somewhat concave or convex form. Thus, the device can be arranged so that the elongated means can be introduced into the sack, wherein the elongated means extends through the opening and projects into the sack and simultaneously bring the first side of the plate against the outer side of the sack around a periphery of the opening for closing or filling the sack. Then the device can be removed from the sack and reused in connection with the same or another sack. The plate can also comprise a frame or a rubber moulding projecting in a direction towards the sack for further sealing and closure. Suitably the opposite side of the plate is also substantially flat, even though this can be formed differently. Suitably the plate is arranged larger than the opening so that the substantially flat side of the plate is brought against an outer side around the opening of the sack when the elongated means is introduced into the sack through the opening. The plate can be substantially circular, rectangular, triangular or designed with another shape, which is obvious for a person skilled in the art. Further, the elongated means can be arranged in the centre of the plate. The elongated means and the plate are suitably formed with dimensions and in a material to provide an easily handled device having low weight. For example, the elongated means and the plate are formed in plastic materials, wood or metal, such as aluminium.

According to one embodiment of the invention the elongated means can comprise a head or the similar to be enclosed by the content of the sack so that the device is retained at the sack. Thus the head provides a blocking jam of the elongated means in the sack principally as a result of the content of the sack between the opening and the head forming a resistance, wherein the elongated means not unintentionally exits the sack. Consequently a full or partially filled sack can be closed by introducing the elongated means into the sack through an opening arranged in a lower portion of the sack while the plate is brought against the outer side around the opening of the sack, wherein the plate further closes the opening in the sack. The head may comprise a helical groove for engaging the material in the sack for additional fastening thereto. Alternatively, the helical groove can be arranged projecting from the head, forming a thread ridge.

The elongated means may further comprise a screw for engaging the material in the sack or a sheet arranged in the sack to provide additional fastening of the device to the sack. Thus the device can be screwed into the sack until the plate abuts against the outer side of the sack and the device is fixed. According to one alternative embodiment the screw is formed as a double-thread-screw. However, the design of the screw can be varied, which is obvious for a person skilled in the art.

According to one alternative embodiment of the invention the elongated means can be formed as a cylinder having a cone-shaped top. However, other designs of the elongated means are also possible, which is obvious for a person skilled in the art. The elongated means can be arranged to be brought through a sheet of the device. The sheet can comprise an aperture corresponding to the elongated means so that the elongated means can be brought through the sheet, wherein the screw of the elongated means engages the sheet.

The sheet can be arranged to be brought into the sack through the opening thereof. The sheet may be foldable so that the sheet can be folded to facilitate introduction into the sack. After the sheet has been introduced into the sack it is unfolded so that one side thereof abuts against an inner side of the sack, wherein the elongated means can be screwed into the aperture in the sheet to fasten the device to an empty sack and block the opening thereof. The sheet may comprise recesses to facilitate engagement of the screw of the elongated means.

According to yet another alternative embodiment of the invention the elongated means can be formed by a tube element for refilling material into a sack. In this embodiment the plate comprises a through aperture corresponding to the tube element, wherein material can be brought through the plate and further through the tube element and into the sack through an opening in the upper portion of the sack. Thus the elongated means in the form of a tube element can be introduced into an opening in the upper portion or upper side of an unfilled sack and screwed into the sheet for refilling the sack with material.

According to yet another alternative embodiment of the invention the elongated means can be formed as a helical screw to be screwed into the material in an at least partially filled sack, wherein the helical screw engages the material in the sack for fastening the device while blocking an opening in the lower portion or bottom of the sack by means of the plate.

In this manner both an unfilled and an at least partially filled opened single use sack, such as a conventional big-bag, can be closed again. Then, the remaining material in the sack can be stored at least temporarily. When the remaining material is to be used the device is removed from the opening in the sack, wherein the content of the sack can exit. Alternatively, an unfilled or empty sack can be closed in the bottom and refilled in the upper side.

BRIEF DESCRIPTION OF THE DRAWINGS

The invention will now be described in more detail by means of exemplary embodiments and with reference to the accompanied drawings, of which

THE INVENTION

Figure 1:
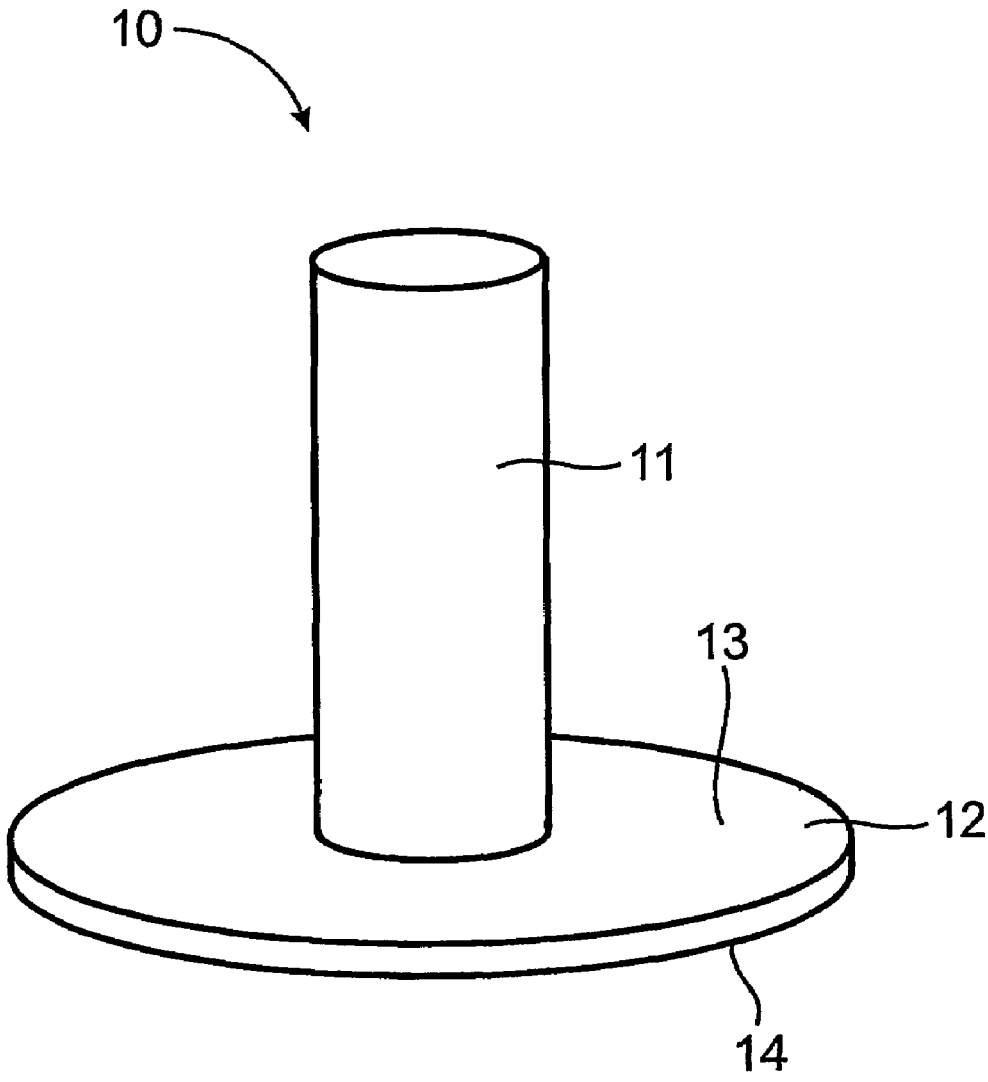
FIG. 1 is a schematic perspective view of the device for filling or closing an opened single use sack according to a first embodiment of the invention.

With reference to FIG. 1 a device 10 for closing or filling sacks, such as single use big-bags for storing, for example, grain, seed, synthetic fertilizer, pellets, granules, etc., according to a first embodiment of the present invention is illustrated. The device 10 comprises an elongated means 11 and a plate 12. The elongated means 11 is attached to the plate 12, wherein the elongated means 11 projects substantially perpendicular from the plate 12. The elongated means 11 is attached to the plate by conventional means, such as by means of screws, nails or the similar and/or glue or another adhesive. Alternatively the elongated means 11 and the plate 12 are formed in one integrated piece. The elongated means 11 is arranged for introduction into an at least partially filled or empty sack through an opening arranged in the sack. For example, the elongated means 11 is formed with a substantially circular circumference or substantially circular cross section for introduction into an opening in the sack having a corresponding shape. Suitably the elongated means 11 comprises a flat side for abutment against the plate 12.

The plate 12 comprises at least one substantially flat first side 13 for abutment against the elongated means 11 and for abutment against an outer side of the sack. Thus, the device 10 is arranged so that the elongated means 11 can be introduced into the sack, wherein the elongated means 11 extends through the opening and projects into the sack while bringing the first side 13 of the plate 12 against the outer side of the sack around a periphery of the opening for the closing or filling of the sack. Suitably, an opposite side 14 of the plate 12 is also flat. The plate 12 is larger than the opening so that the substantially flat side of the plate 12 is brought against an outer side around the opening of the sack when the elongated means 11 is introduced into the sack through the opening. For example, the plate 12 is substantially circular or rectangular, wherein the elongated means 11 is arranged at the centre of the plate 12. For example, the plate 12 is circular having a diameter between 150 and 175 mm. Suitably, the elongated means 11 and the plate 12 are arranged with dimensions and in a material to provide an easily handled device 10 having low weight. For example, the elongated means 11 and the plate 12 are formed in plastic materials, wood or metal, such as aluminium.

Figure 2:
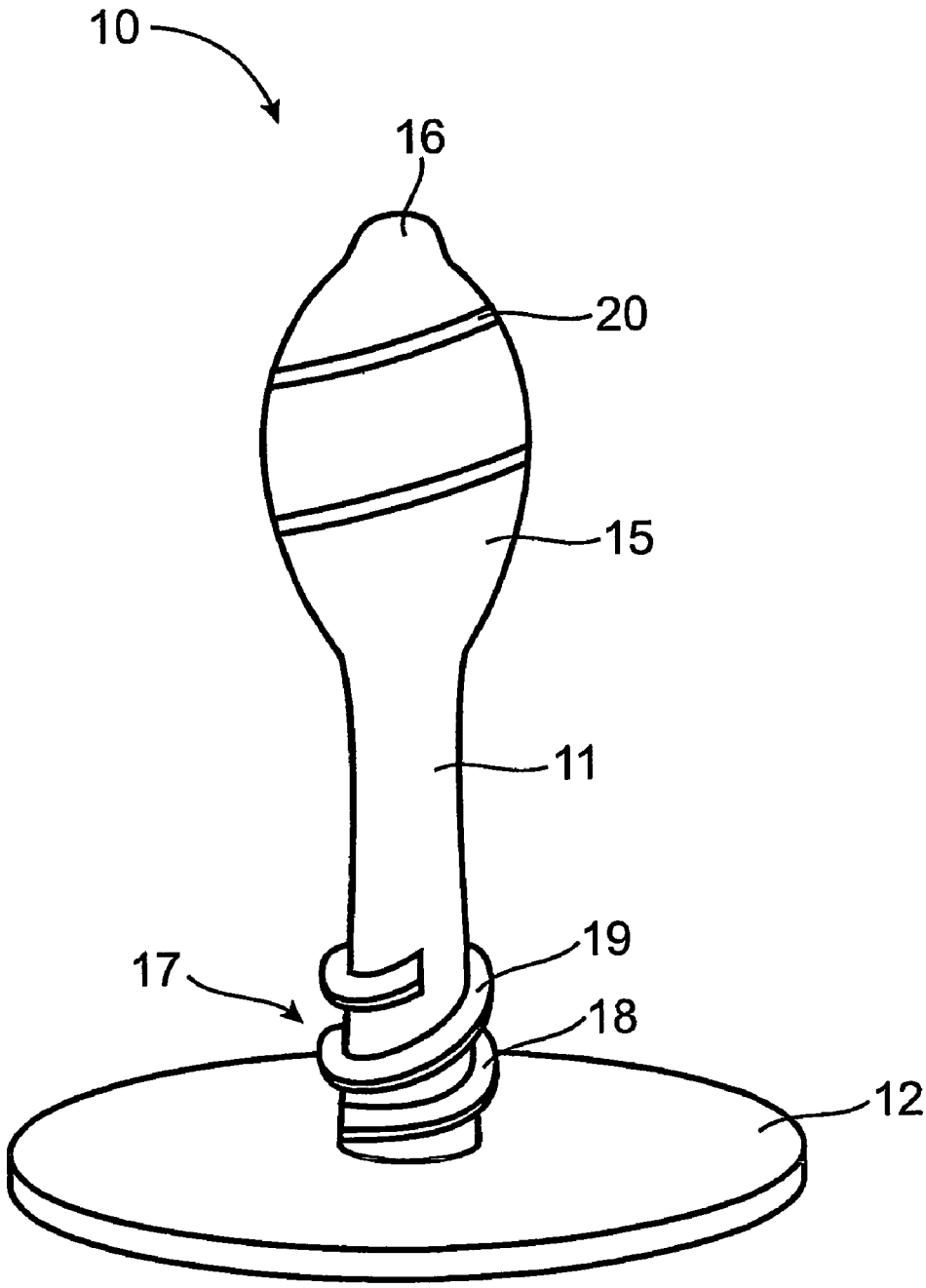
FIG. 2 is a schematic perspective view of the device according to a second embodiment of the invention.

In reference to FIG. 2 a schematic perspective view of the device 10 according to a second embodiment of the present invention is illustrated. In the illustrated second embodiment the device 10 comprises the elongated means 11 and the plate 12, wherein the elongated means 11 is projecting substantially perpendicular from the plate 12. Thus, a first end of the elongated means 11 is connected to the plate 12 and a second end is projecting from that point. The elongated means 11 comprises a head 15 arranged at the second end of the elongated means 11, wherein the head 15 constitutes a portion projecting in the plane of the plate 12 so that the elongated means 11 is provided with a larger cross section area at the second end thereof than at the first end thereof. For example, the head 15 is tapered in a direction along the elongated means 11, wherein the head 15 is formed with a larger cross section area in the middle of the head 15 than towards the first and second ends of the elongated means 11. Thus, the head 15 is tapered towards the second end of the elongated means 11, forming a rounded top 16 for facilitating insertion into an at least partially filled sack. Thus, the rounded top forms the second end of the elongated means 11. The elongated means 11 is arranged to be introduced into an at least partially filled sack, wherein the content of the sack encloses the head 15 for fastening the device 10. Thus, the head results in a blocking of the elongated means 11 in the sack, substantially due to that the content of the sack between the opening and the head 15 forms a resistance so that the elongated means 11 not exits the sack unintentionally. Thus, an at least partially filled sack is closed by introducing the elongated means 11 into the sack through an opening in a lower portion thereof while the plate 12 is brought against the outer side around the opening of the sack.

The plate 12 is arranged for further closing of the opening in the sack by being brought against the outer side of the sack around the opening, wherein outflow of material from the sack between a circumference of the elongated means 11 and the opening is prevented.

The elongated means 11 further comprises a screw 17 arranged at the first end for additional fastening of the device 10 to the sack. The screw 17 is arranged as a thread ridge 18 projecting around the circumference of the elongated means 11 and extending from the first end of the elongated means 11 a suitable distance in a direction towards the second end of the elongated means 11. Further, the screw 17 is arranged to engage the content of the sack, wherein the material in the sack provide a resistance for the screw 17 so that the device 10 can be further fastened to the sack by means of rotation. Thus, the device 10 can be screwed into the sack until the plate 12 abuts against the outer side of the sack and the device is fastened.

The screw 17 is arranged with a suitable pitch to facilitate the fastening function. Suitably, the screw is arranged with a relatively fine pitch at the first end of the elongated means 11 so that a portion of the screw next to the plate 12 is substantially parallel therewith. Alternatively, the entire screw 17 is arranged with the same pitch. According to one embodiment of the present invention the screw 17 is formed as a double-thread-screw, wherein an additional thread ridge 19 is arranged around the circumference of the elongated means 11 so that the screw 17 comprises a first thread ridge 18 and a second thread ridge 19 displaced in relation to the first thread ridge 18. For example, the thread ridges 18, 19 are relatively displaced a half turn.

According to one embodiment of the present invention the head 15 comprises a helical groove 20 for further fastening of the device 10 to the sack. The helical groove 20 is arranged along a circumference of the head 15 and extends from an upper portion of the head 15 at the second end of the elongated means 11 towards a lower portion of the head 15 in a direction towards the first end of the elongated means 11 and the plate 12. The helical groove 20 is arranged to engage the material in the sack so that the device 10 can be fastened thereto by means of rotation.

Thus, according to the second embodiment of the present invention the device 10 is arranged to block an opening in the bottom or lower portion of an at least partially filled sack.

Figure 3:
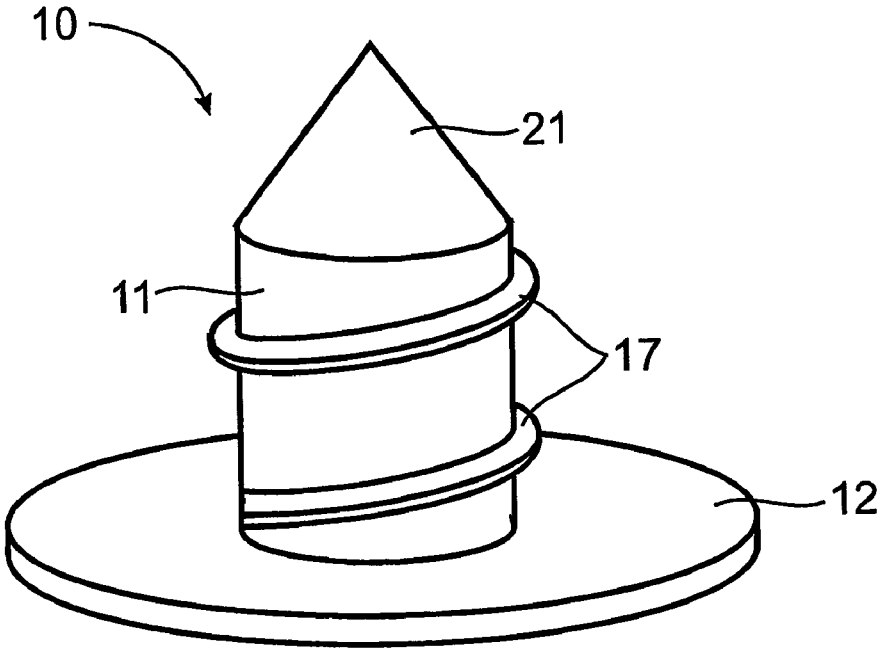
FIG. 3 is a schematic perspective view of the device according to a third embodiment of the invention.

In reference to FIG. 3 a schematic perspective view of the device according to a third embodiment of the present invention is illustrated. In the illustrated third embodiment the device 10 comprises the elongated means 11 and the plate 12, wherein the elongated means 11 is projecting substantially perpendicular from the plate 12. Thus, the first end of the elongated means 11 is connected to the plate 12 and the second end is projecting from that point. For example, the elongated means 11 is formed as a cylinder having a cone-shaped top 21 at the second end of the elongated means 11. However, other designs of the elongated means 11 are also possible, which is obvious for a person skilled in the art.

The elongated means 11 comprises the screw 17, which screw 17 also in the third embodiment may be formed as a double-thread-screw. According to the third embodiment of the present invention the screw extends from the first end of the elongated means 11 towards the cone-shaped top 21.

Figure 4:
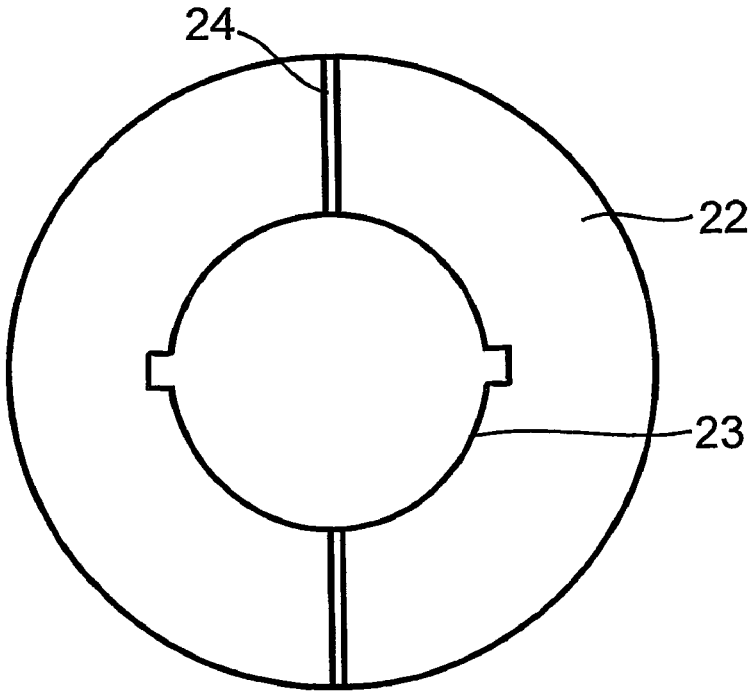
FIG. 4 is a schematic view from above of a sheet of the device according to FIG. 3.

In reference to FIG. 4 a sheet 22 of the device 10 according to a fourth embodiment of the present invention is illustrated. The sheet 22 comprises an aperture 23 corresponding to the elongated means 11 so that the elongated means 11 can be brought through the sheet 22, wherein the screw 17 of the elongated means 11 engages the sheet 22. Thus, the aperture 23 extends through the sheet 22. For example, the sheet 22 and the aperture 23 are circular.

The sheet 22 is arranged to be introduced into the sack through the opening therein. In the embodiment shown, the sheet 22 is foldable so that the sheet 22 can be folded by means of a notch 24 or the similar, wherein the plate 22 is foldable to facilitate introduction into the sack through the opening. Suitably, the notch 24 extends along the middle of the sheet 22 so that the sheet can be folded along the middle. Thus, the notch 24 is arranged across the sheet 22. After the sheet 22 has been brought into the sack it is unfolded so that one side thereof abuts against an inner side of the sack, wherein the elongated means 11 according to the third embodiment of the invention can be screwed into the aperture 23 in the sheet 22 for fastening the device to the sack and blocking the opening therein.

Thus, in reference to FIG. 3 and FIG. 4 the screw 17 according to the third embodiment of the invention is arranged to engage the sheet 22 around the aperture 23, wherein an opening in the bottom or lower portion of an empty sack can be blocked.

Figure 5:
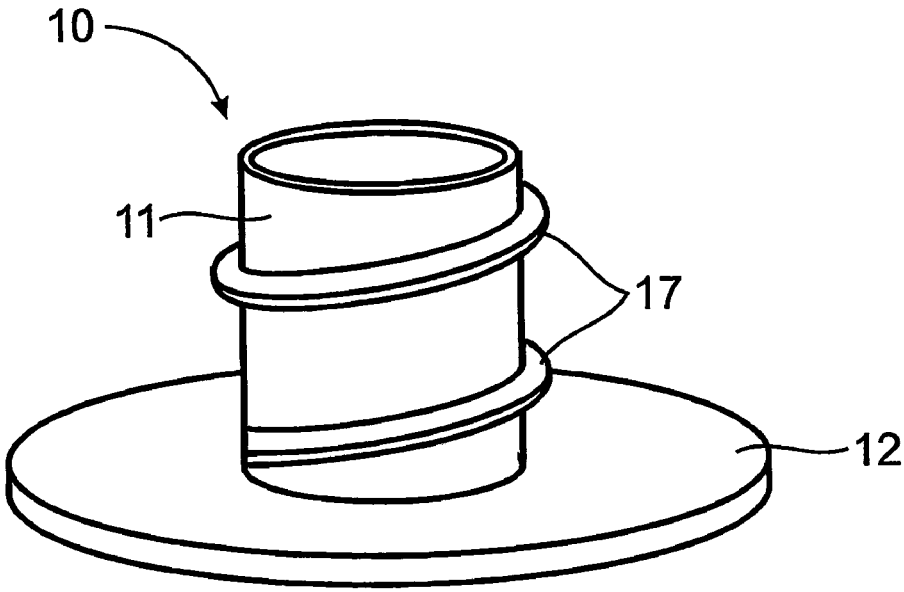
FIG. 5 is a schematic perspective view of the device according to a fourth embodiment of the invention.

In reference to FIG. 5 a schematic perspective view of the device according to a fourth embodiment is illustrated. In the illustrated fourth embodiment the device 10 comprises the elongated means 11 and the plate 12, wherein the elongated means 11 is projecting substantially perpendicular from the plate 12. Thus, the first end of the elongated means 11 is connected to the plate 12 and the second end is projecting from that point. According to the fourth embodiment the elongated means 11 is arranged as a tube element for refilling a sack with material. In this embodiment the plate 12 comprises a through aperture corresponding to the tube element, wherein material can be brought through the plate 12 and further through the tube element and into the sack through an opening in the upper portion of the sack.

The elongated means 11 further comprises the screw 17, which screw 17 also in the fourth embodiment may be formed as a double-thread-screw. According to the fourth embodiment of the present invention the screw 17 extends from the first end of the elongated means 11 towards the second end thereof.

Figure 6:
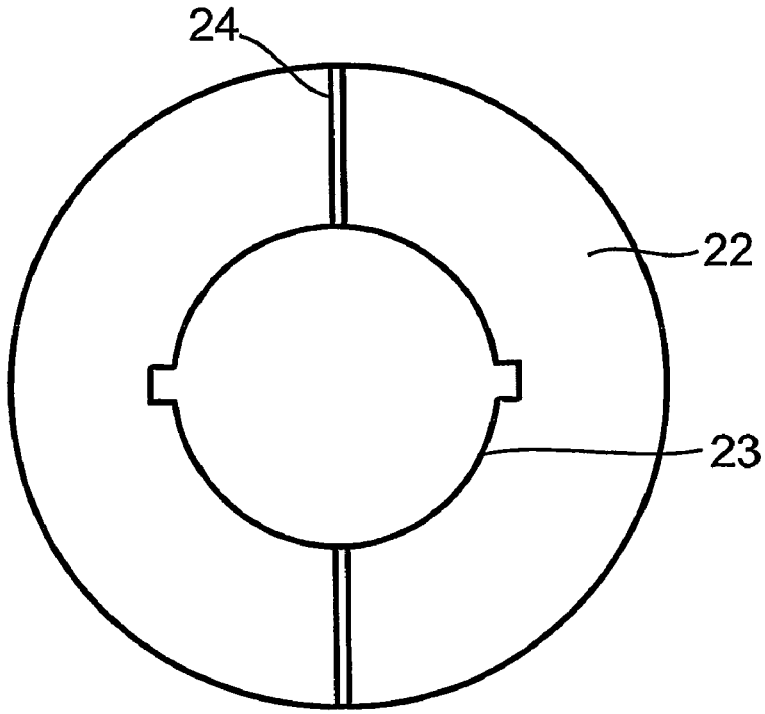
FIG. 6 is a schematic view from above of a sheet of the device according to FIG. 5.

In reference also to FIG. 6 a sheet 22 of the device according to the fourth embodiment of the present invention is illustrated. The sheet 22 comprises an aperture corresponding to the elongated means 11 in the form of a tube element so that the elongated means 11 can be brought through the sheet 22, wherein the screw 17 of the elongated means 11 engages the sheet 22. Thus, the aperture 23 extends through the sheet 22. For example, the sheet 22 and the aperture are circular.

The sheet 22 is arranged for introduction into the sack through the opening thereof. In the embodiment shown, the sheet 22 is foldable so that the sheet 22 can be folded by means of a notch 24 or the similar, wherein the plate 22 is foldable to facilitate introduction into the sack through the opening. Suitably, the notch 24 extends along the middle of the sheet 22 so that the sheet can be folded along the middle. Thus, the notch 24 is arranged across the sheet 22. After the sheet 22 has been brought into the sack it is unfolded so that one side thereof abuts against an inner side of the sack, wherein the elongated means 11 according to the fourth embodiment of the invention can be screwed into the aperture 23 in the sheet 22 for fastening the device to the sack and blocking the opening therein.

Thus, in reference to FIG. 5 and FIG. 6 the screw 17 according to the fourth embodiment of the invention is arranged to engage the sheet 22 around the aperture 23, wherein the elongated means 11 in the form of a tube element can be introduced into an opening in the upper portion or upper side of an unfilled or empty sack and screwed into the sheet 22 for refilling the sack with material. Thus, the elongated means 11 is screwed into the sack via the sheet 22 until the plate 12 abuts against an outer side of the upper portion of the sack. The tube element is arranged to be introduced into an unfilled sack through an opening arranged in the upper portion of the sack for the tube element, wherein the tube element is introducible into the sack for refilling thereof. Thus, according to the fourth embodiment the device 10 comprises a foldable sheet 22 having an aperture corresponding to the elongated means 11, the sheet 22 being arranged to be introduced into the sack through the opening in a folded condition and unfolded abut against an inner side around the opening of the sack for engaging the screw 17 of the elongated means 11, wherein the plate 12 is forced against the sheet 22 via the sack by rotation for fastening the device 10 to the sack.

Figure 7:
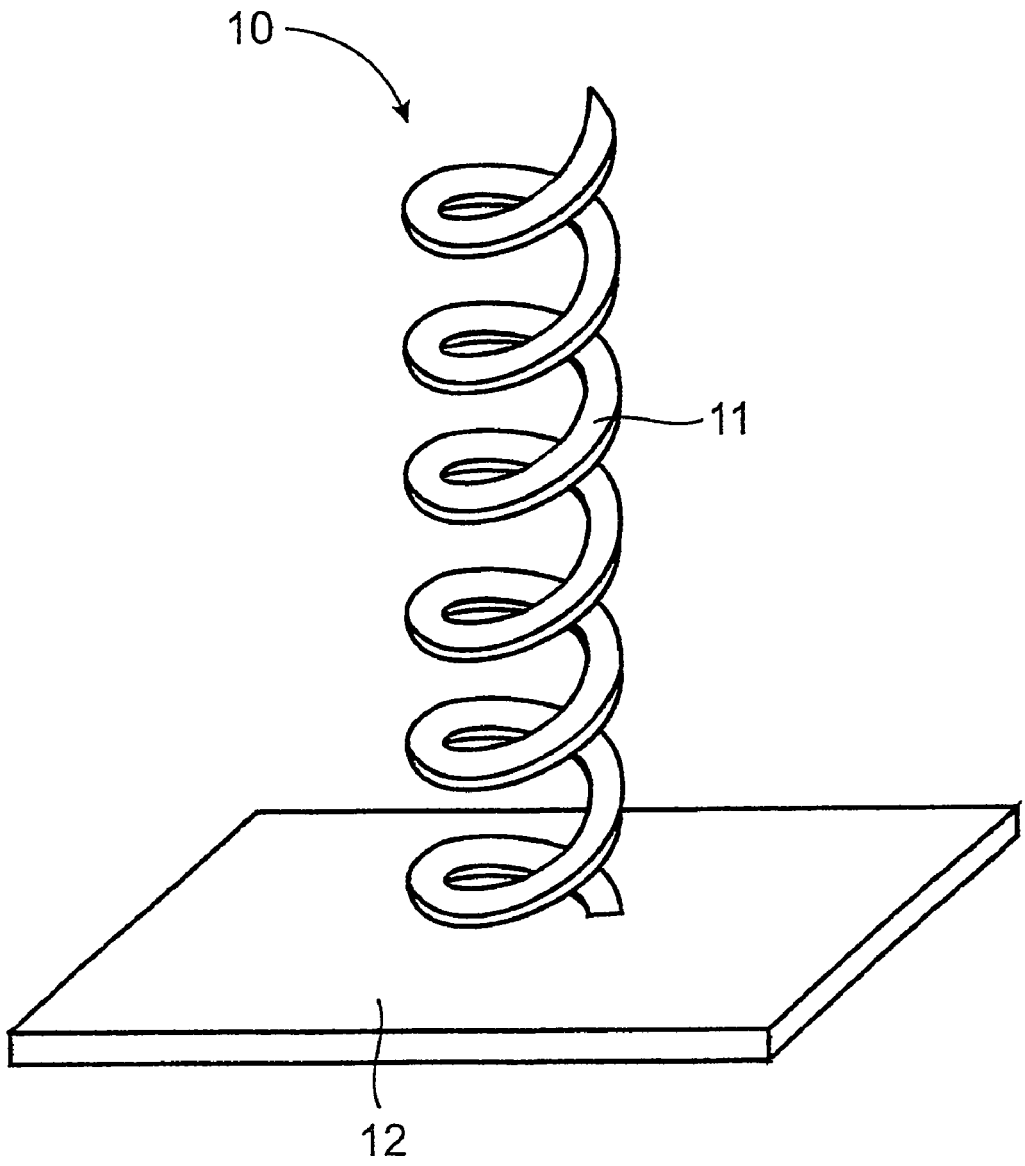
FIG. 7 is a schematic perspective view of the device according to a fifth embodiment of the invention.

In reference to FIG. 7 a schematic perspective view of the device 10 according to a fifth embodiment of the invention is illustrated. According to the fifth embodiment the device 10 comprises the elongated means 11 and the plate 12, wherein the elongated means 11 is projecting substantially perpendicular from the plate 12. Thus, the first end of the elongated means 11 is connected to the plate 12 and the second end is projecting from that point. For example, the elongated means 11 is formed as a helical screw to be screwed into an at least partially filled sack, wherein the helical screw engages the material in the sack for fastening the device while blocking an opening in the lower portion or bottom of the sack by means of the plate 12. According to the fifth embodiment the plate 12 is rectangular. Alternatively, the plate is formed in another suitable shape, which is obvious for a person skilled in the art with the teachings of the invention.

Figure 8:
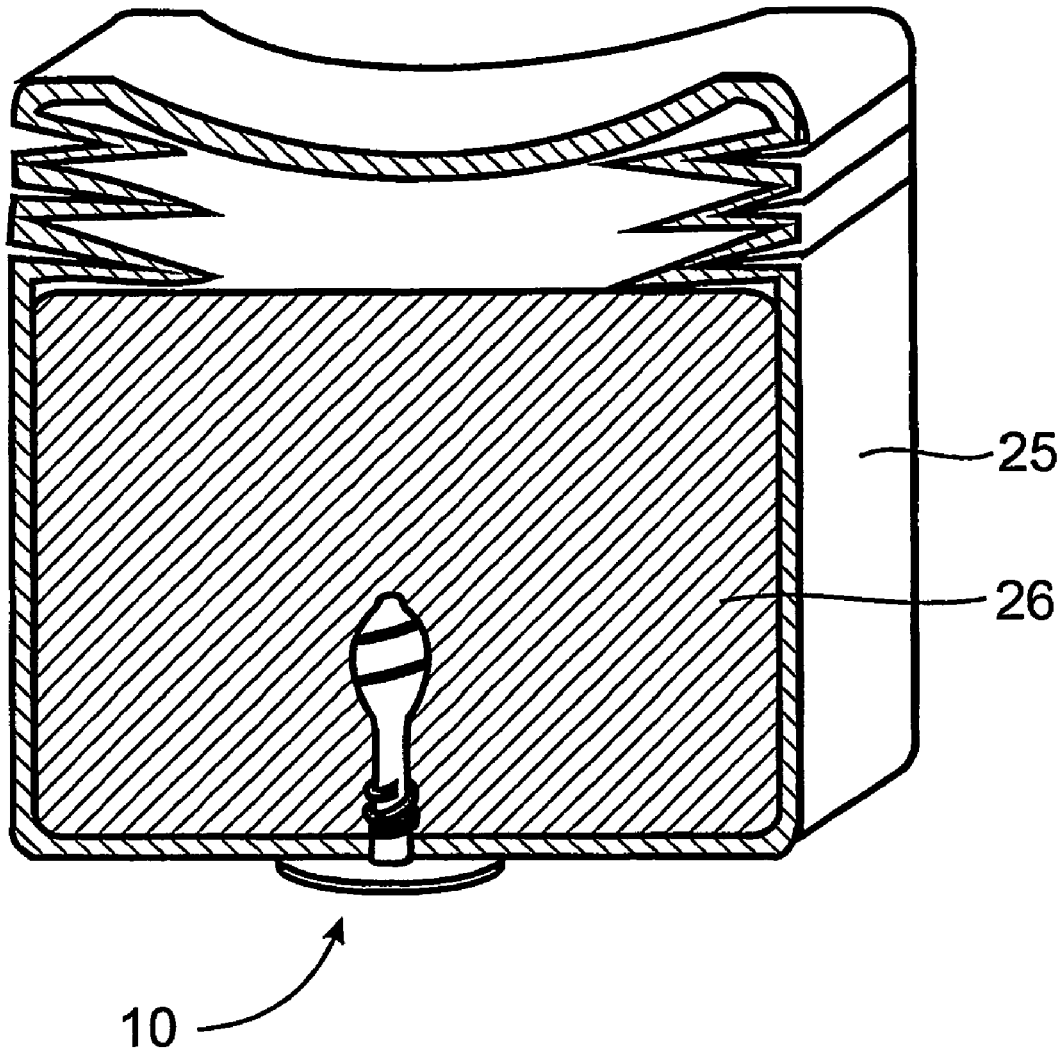
FIG. 8 is a schematic cross section view of the device according to FIG. 2 and a partially filled sack.

In reference to FIG. 8 a schematic cross section view of the device according to FIG. 2 and a partially filled sack is illustrated. The elongated means 11 is introduced into the sack 25 through an opening arranged in the bottom thereof. The opening is arranged to correspond to the elongated means 11 so that the elongated means 11 can be brought into the sack while the plate 12 is brought into contact with the outer side of the sack to block the opening. As described previously the screw 17 and the groove 20 engage a material 26 in the sack 25 and the head 15 is enclosed by the material 26, wherein the device 10 is fastened thereto while blocking the opening. By this manner an opened sack 25 of single use type, such as a conventional big-bag, can be closed again at least temporarily. Then, remaining material 26 in the sack can be stored. When the remaining material 26 is to be used the device 10 is removed from the opening, wherein the content of the sack 25 can exit the sack 25.

Figure 9:
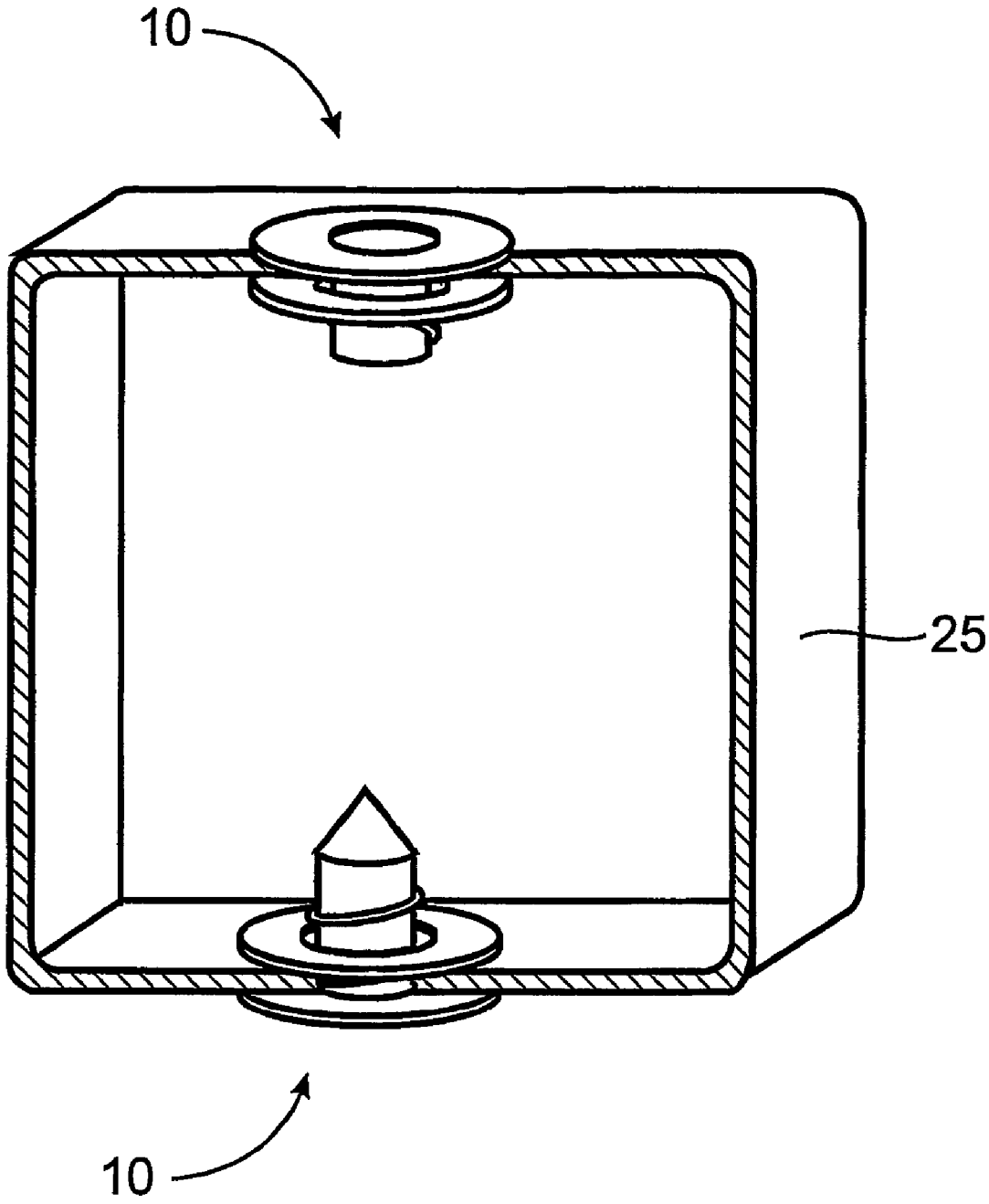
FIG. 9 is a schematic cross section view of the device according to FIGS. 3 and 5 with the corresponding sheet and an unfilled sack.

In reference to FIG. 9 a schematic cross section view of the device according to FIGS. 3 and 5 with the associated sheet 22 and an unfilled sack 25 is illustrated. The device 10 according to the third embodiment of the invention is arranged at the bottom of the sack 25 for blocking an opening in the bottom of the sack 25, which is unfilled. The device according to the fourth embodiment of the invention is arranged at an upper side of the sack 25 for refilling the unfilled sack 25 with material 26.

The invention claimed is:

1. A method for closing an opening in an at least partially filled sack for storing different materials in the form of pellets, granules, grain, seed or similar, comprising the steps of introducing an elongated means into the sack through the opening for closing thereof, bringing a substantially flat side of a plate connected to a first end of the elongated means into contact with an outer side around the opening when the elongated means is introduced into the sack, and retaining the elongated means in the sack through a head or a screw thread arranged in the vicinity of a second end of the elongated means, the elongated means provided with a larger cross section area at the second end than at the first end thereof or provided with a portion projecting substantially perpendicular from the elongated means, the elongated means at least partially along its extent being enclosed by the material inside the sack so that the material between the opening and the head or screw thread forms a resistance to retain the elongated means inside the sack.

2. A method according to claim 1, wherein a foldable sheet having an aperture corresponding to the elongated means is introduced into the sack through the opening in a folded condition and then unfolded and brought into contact with an inner side around the opening of the sack.

3. A method according to claim 2, wherein the elongated means is brought through the aperture and the screw thread is brought to engage the sheet, wherein the plate by rotation is forced against the sheet via the sack when fastening the elongated means and plate thereto.

4. A method according to claim 1, wherein the elongated means is screwed into the sack by means of the screw thread arranged around a periphery of at least a portion of the elongated means, wherein the elongated means and plate by rotation are fastened to the sack.

5. A method for closing an opening in an at least partially filled sack for storing different materials in the form of pellets, granules, grain, seed or similar, comprising the steps of introducing both an elongated means and a foldable sheet into the sack through the opening for closing thereof, the foldable sheet carried by the elongated means along its extent, bringing a substantially flat side of a plate connected to a first end of the elongated means into contact with an outer side around the opening when the elongated means is introduced into the sack, the foldable sheet brought into contact with an inner side around the opening so as to at least partially close the opening from inside the sack, and retaining the elongated means in the sack through a projecting portion projecting from a second end of the elongated means, to be enclosed at least partially along its extent by the material inside the sack so that the material between the opening and the projecting portion forms a resistance to retain the elongated means inside the sack.

6. A method according to claim 5, wherein the foldable sheet has an aperture and the elongated means extends through the aperture, wherein the foldable sheet is introduced into the sack through the opening in a folded condition and then unfolded and brought into contact with the inner side around the opening of the sack.

7. A method according to claim 6, wherein the elongated means is screwed into the sack by means of a screw thread arranged around a periphery of at least a portion of the elongated means, wherein the elongated means is brought through the aperture and the screw thread is brought to engage the sheet, wherein the plate by rotation is forced against the sheet via the sack when fastening the elongated means and plate thereto.

8. A method according to claim 5, wherein the elongated means is screwed into the sack by means of a screw thread arranged around a periphery of at least a portion of the elongated means, wherein the device by rotation is fastened to the sack.

9. A method according to claim 5, wherein a head arranged in one end of the elongated means is introduced into an at least partially filled sack, wherein the device is fastened to the sack by the material enclosing the head.

* * * * *